US005172761A

United States Patent [19]

Lyon

[11] Patent Number: 5,172,761

[45] Date of Patent: Dec. 22, 1992

[54] HEAT EXCHANGER TANK AND HEADER

[75] Inventor: Peter A. Lyon, Lockport, N.Y.

[73] Assignee: General Motors Corporation, Detroit, Mich.

[21] Appl. No.: 883,739

[22] Filed: May 15, 1992

[51] Int. Cl.[5] ..... F28F 9/02

[52] U.S. Cl. ..... 165/173; 165/176; 165/906

[58] Field of Search ..... 165/150, 173, 174, 176, 165/906

[56] References Cited

U.S. PATENT DOCUMENTS

| | | | |
|---|---|---|---|
| 2,028,457 | 1/1936 | Karmazin | 165/150 X |
| 2,064,036 | 12/1936 | Sandberg | 165/149 X |
| 4,485,867 | 12/1984 | Melnyk et al. | 165/173 |
| 4,917,180 | 4/1990 | Wolf et al. | 165/150 |
| 4,971,145 | 11/1990 | Lyon | 165/173 |

FOREIGN PATENT DOCUMENTS

| | | | |
|---|---|---|---|
| 2222623 | 10/1974 | France | 165/176 |

*Primary Examiner*—Allen J. Flanigan
*Attorney, Agent, or Firm*—Patrick M. Griffin

[57] ABSTRACT

A heat exchanger is formed by a pair of tanks with heat exchanger tubes connected therebetween. The tanks include a header plate with chamber indentions that cooperates with a tank plate to form a row of tank chambers for interconnecting the heat exchanger tubes joined to the header plate. The header plate has a plurality of tube indentations or dimples which extend at adjacent tube apertures and are contacted by a continuous tank rib on the tank plate within each chamber. The ribs and dimples provide substantially uniform contacting and sealing surfaces during brazing to strengthen the assembled header. The tank rib includes tube slots opposing the apertures in the tube plate to provide a stop for insertion of the exchanger tubes.

4 Claims, 4 Drawing Sheets

HEAT EXCHANGER TANK AND HEADER

TECHNICAL FIELD

The invention relates to heat exchanger headers and more particularly with respect to reinforcement of the header assembly.

BACKGROUND OF THE INVENTION

Tube and air center heat exchangers, such as used in motor vehicle air conditioning system condensers, commonly have a plurality of parallel flat sided extruded tubes connected at opposite ends to a pair of headers. Air centers between the tubes facilitate efficient heat transfer to the surrounding area. The headers generally comprise a header plate with tube receiving apertures and a tank secured to the header plate to supply refrigerant and receive same from the tubes. The air centers are brazed to the sides of adjacent tubes and the tubes are brazed or otherwise bonded to the header plates along with the tanks to assure leak free joints.

To reinforce the assembly, it is known to provide internal brazed sections of the header to the tube plates, as disclosed in U.S. Pat. No. 4,971,145, issued Nov. 20, 1990 having common inventor and assignee. The patent discloses a heat exchanger header providing transverse projections in the tube header plate that are contacted at a point intermediate their length by corresponding projections formed in the tank header plate. Braze cladding alloy is provided on the plates for effecting brazing of the plates at their mating surfaces and the points of contact between the projections. This provides a rigid header construction consisting of only two plates with enhanced burst pressure strength that allows a reduction in plate thickness and/or increase in core depth as compared with prior designs. However, the dimple joint design has inherent stress risers therein.

SUMMARY OF THE INVENTION

The invention is a heat exchanger tank comprising a header plate having tube apertures for receiving heat exchanger tubes, and a tank plate parallel with said header plate and having chamber indentions in one side thereof facing the header plate. The plates have mating surfaces surrounding the chamber indentions so as to define tank chambers open to selected ones of the tube apertures. The header plate has a plurality of tube indentations formed therein extending at the selected adjacent ones of the tube apertures. The tank plate has a continuous tank rib extending with in the chamber indentations to form a projection on one side facing the header plate for contacting the tube indentations. A bonding material effectively bonds the plates at the mating surfaces and the points of contact between the indentations and ribs.

BRIEF DESCRIPTION OF THE DRAWINGS

Advantages and features of the invention will be more readily apparent from the following detailed description when taken in conjunction with the accompanying drawings wherein.

DESCRIPTION OF THE PREFERRED EMBODIMENT

Figure 1:
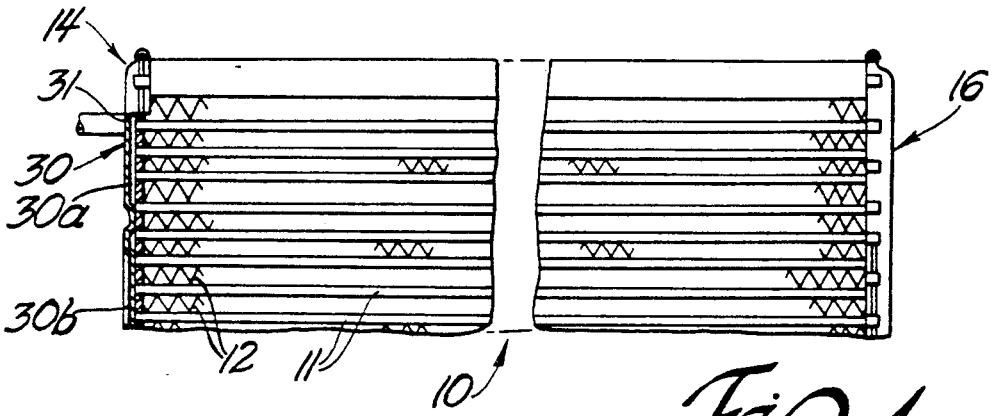
FIG. 1 is a partial front view of a heat exchanger having a preferred embodiment of the headers according to the invention.

Referring to FIG. 1, the heat exchanger 10 there shown comprises a plurality of flat sided extruded tubes 11 arranged in parallel relationship and air centers 12 of sinusoidal configuration arranged therebetween for thermal coupling the tubes 11 with the ambient air. The ends of the tubes 11 are connected to tanks 14 and 16 that interconnect the tubes 11 for fluid passes across the heat exchanger 10. While the ensuing description is directed toward a heat exchanger 10 comprising a condenser for a motor vehicle air conditioning system, the invention clearly applies to other heat exchangers as well.

Figure 2:
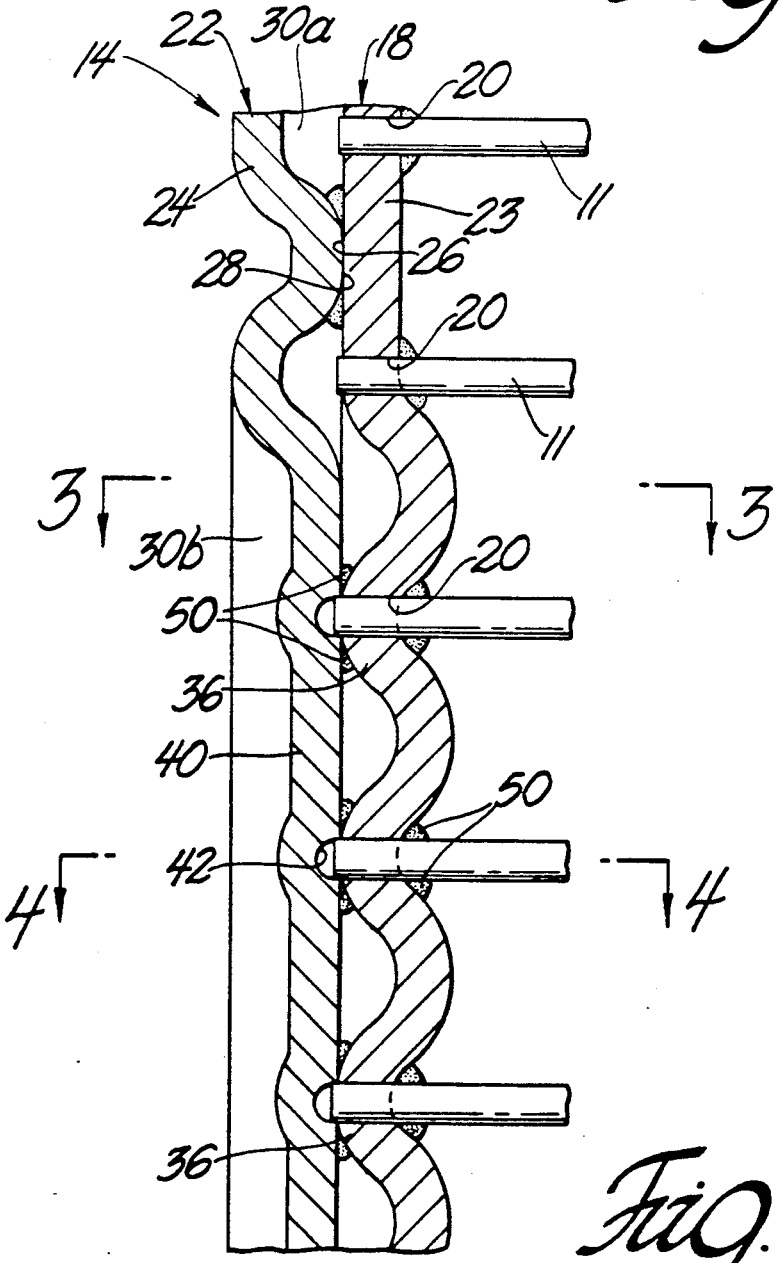
FIG. 2 is an enlarged view of the broken away section of FIG. 1.
Figure 4:
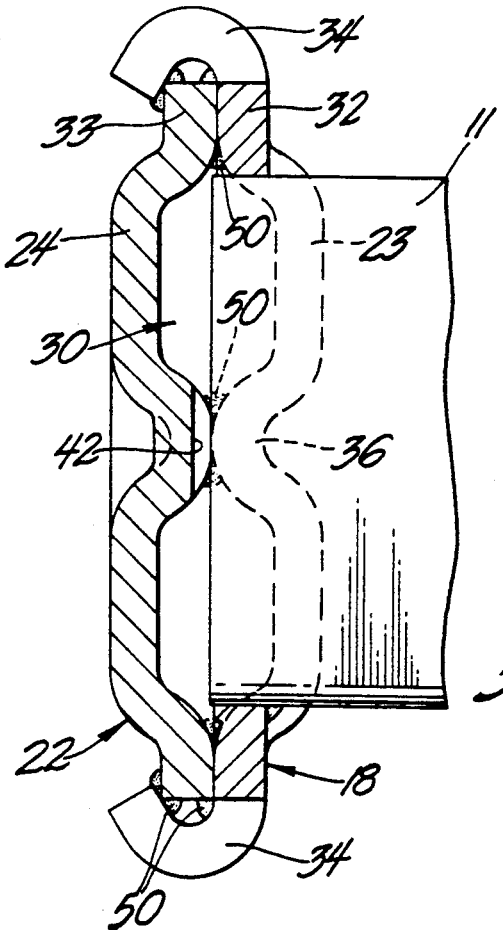
FIG. 4 is a view taken along lines 4—4 in FIG. 2.
Figure 3:
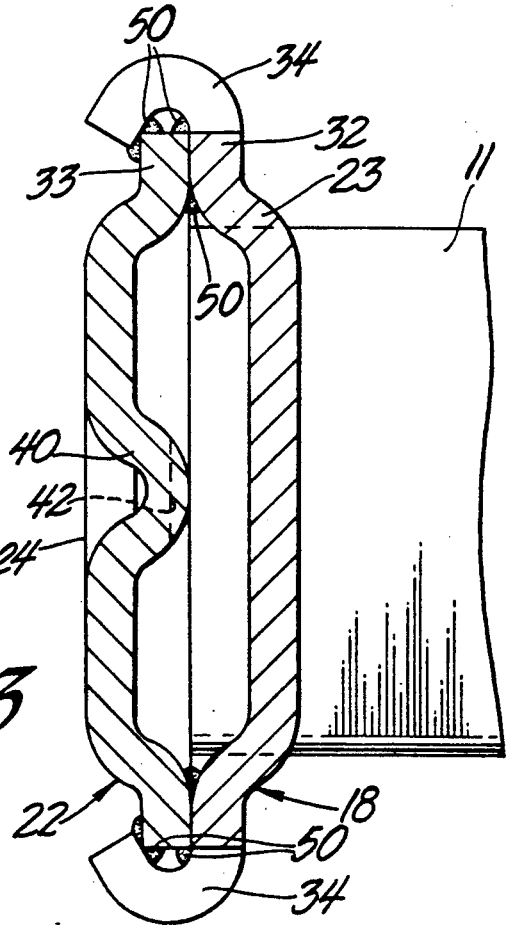
FIG. 3 is a view taken along lines 3—3 in FIG. 2.
Figure 6:
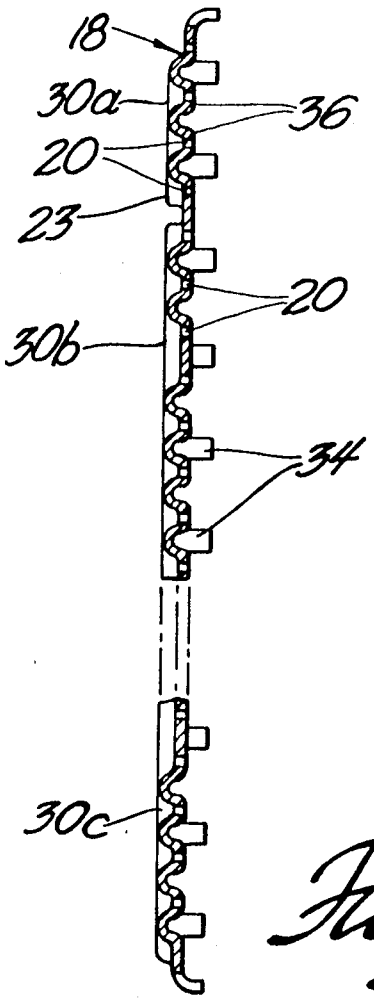
FIG. 6 is a view taken along lines 6—6 of FIG. 5.
Figure 8:
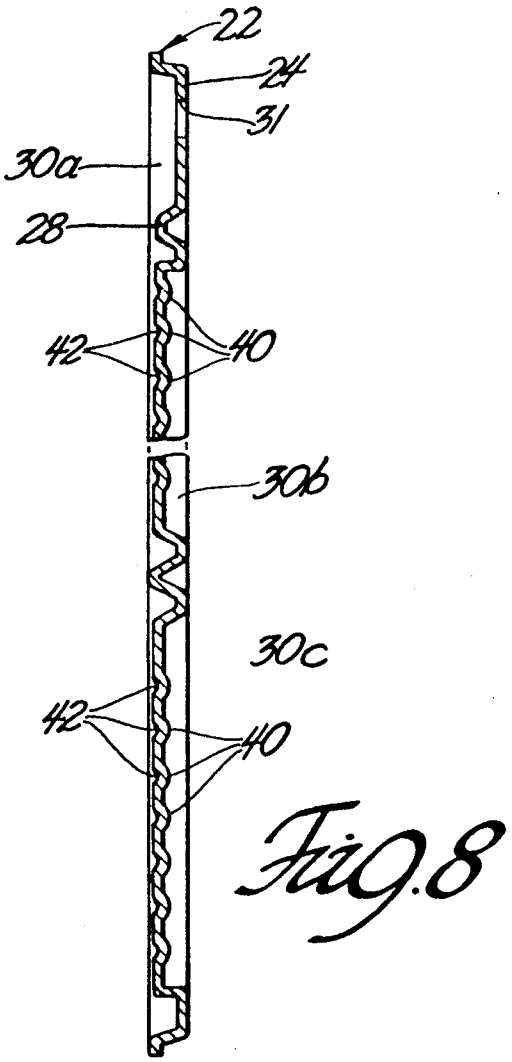
FIG. 8 is a view taken along lines 8—8 of FIG. 7.
Figure 7:
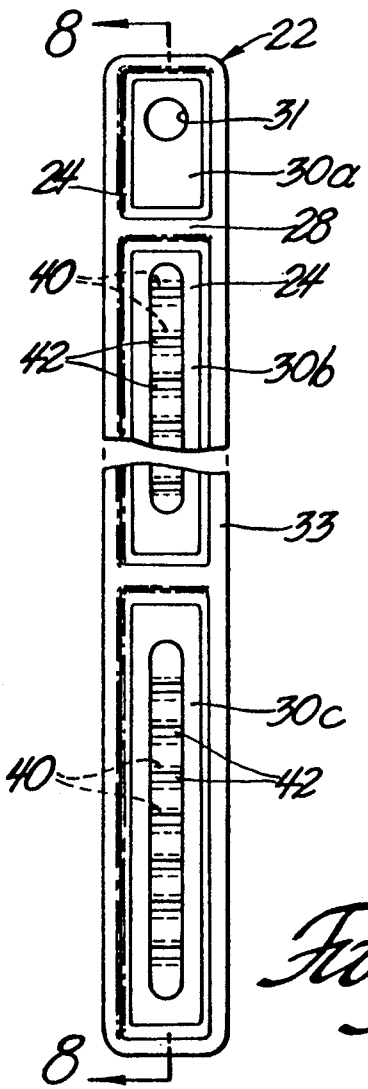
FIG. 7 is a side view of one of the tank header plates in FIG. 1.

The tanks 14, 16 are formed of two longitudinal plates 18, 22 as generally shown in FIGS. 2–8. The tank 14 includes a header plate 18 having apertures 20 for receiving the tubes 11, and a tank plate 22. The header plate 18 and tank plate 22 have chamber indentations 23, 24 in one side thereof, each indentation of a depth equal to the metal thickness of the plate. The chamber indentations 23, 24 extend from margins 32, 33 of the plates. The chamber indentations 23, 24 face one another producing chambers 30 of a depth of two times the metal thickness, as best seen in FIGS. 2–4. The header and tank plates 18, 22 have chamber mating surfaces 26, 28 surrounding the indentations 23, 24 so that the latter in cooperation with the header plate 18 define a row of tank chambers 30*a*, 30*b*, and 30*c* open to selected ones of the tubes 11. For example, in the condenser arrangement shown, there are an odd number of passes, namely five, so that the inlet 30 and outlet of the condenser are at opposite corners thereof. There are four tubes 11 on the first pass, twelve tubes 11 total for the second and third passes, and thirteen tubes 11 total for the forth and fifth passes. On the other hand, wherein an even number of passes is provided, the outlet and inlet will be in the same tank. Thus, the characteristic of different condenser models can be designed by the selection of the indentations, thereby giving flexibility of design. For the fitting connection at the tank 14, the tank plate 22 has an aperture 30 in the upper chamber 30*a* as illustrated in FIGS. 7 and 8 for receiving a tube fitting (not shown) for connecting one end of the flow circuit of the condenser in the air conditioning system.

Figure 5:
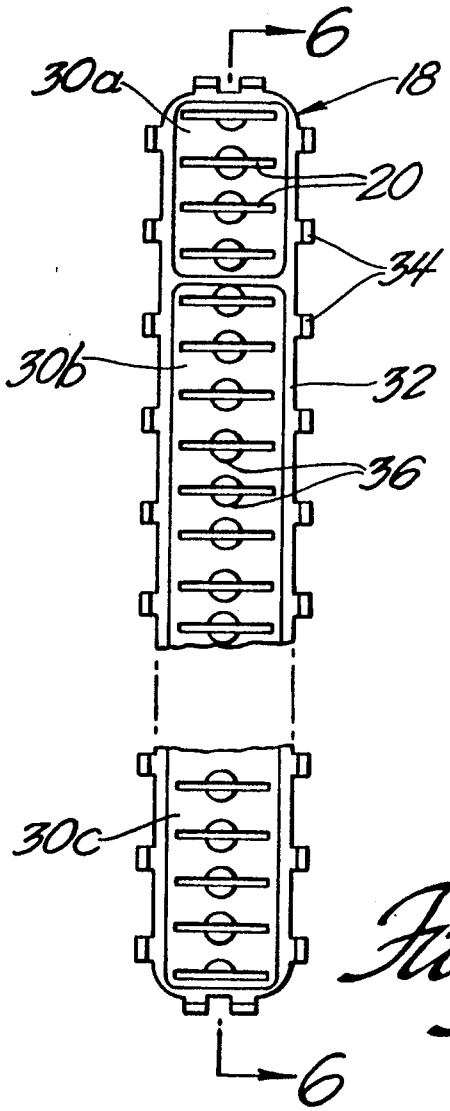
FIG. 5 is a tank side view of one of the tube header plates in FIG. 1.

Each of the header plates 18 has a row of tube indentations 36 forming raised dimples on the tank or pressure side of the plate 18 and at selected adjacent ones of the tube apertures 20 within each chamber 30. The height of the indentations 36 is seen in FIGS. 2, 3, 4 and 6 as about equal to the metal thickness of the material. The material is very readily formable by a stamping operation and adds substantial strength immediately adjacent the tube 11 ends. As seen in FIG. 5, the indentations 36 suspend centrally at each tube aperture 20 and have a generous radius so as not to present stress risers.

The tube indentations 36 occur the length of the header plate 18 along its longitudinal center line, discontinued by the tube apertures 20 therethrough and chamber indentations 23. The flat mating indentation 23 are provided at the mating surface 26 between chamber 30, and along with the tube indentation 36, allow for periodic flat mating surfaces 26, 28.

The tank plate 22 has a continuous tank rib 40 extending within the indentation 24 or chamber 30 so as to have a continuous projection on its pressure side to continuously contact the tube indentations 36 of the header plate 18 at points about the apertures 20 as best seen in FIGS. 3, 4, and 7–8. The tank rib 40 includes tube stops 42 providing slight indentations or slots within the tank rib 40 and aligned with the apertures 20 of the header plate 18 to receive the ends of the tubes 11. The tube stops 42 have a height about one-quarter of the thickness of the material. This allows the tubes 11 to be inserted through the header plate 18 and extend within the chambers 30 with the end of the tubes 11 extending past the header plate 18, as best shown in FIG. 2.

The tank rib 40 extends centrally through each indentation 24 except for the first and last apertures 20 of a chamber 30, where it returns to form the chamber indentation 24 prior to forming the mating surface 28. Therefore, the tank rib 40 and the tube indentations 36 provide contact surfaces for the substantial length of the chambers 30 at each aperture 20, providing a strengthened header 14, 16 without the multiple stress risers of the prior art. The tube stops 42 receiving the ends of the tubes 11 serve a dual purpose of retaining the insertion of the tubes 11 through the tanks 14, 16 and of allowing the central tube 11 ports to remain open to flow.

Clinched tabs 34 are spaced about and extend outwardly from the margin 32 of the header plate 18 and are adapted to be clinched over the margin 33 of the tank plate 22 as shown in FIGS. 3 and 4 to hold the parts together in preparation for brazing as described in more detail subsequently. The margins 32, 33 encompass the chambers 30 and provide the mating surfaces 26, 28 thereabout. The indentations 24 in the tank plate 22 taper to a width less than the width of the tubes 11 as seen in FIGS. 3 and 4.

Conventional aluminum heat exchanger materials are employed so that conventional brazing can be used. All the parts comprise the base material of aluminum 3003 and the header plate 18 is clad with a low melting point brazing material. Alternatively, other alloy combinations appropriate to the intended brazing process may be used. The plates 18, 22 are of uniform but not necessarily the same thickness as shown and are preferably heavy gauge, for example, 0.125 inches, so that secure connections can be made with the tubes 11 and tube fittings to achieve high burst pressure capability. An approximate cladding material thickness is 0.005 is on each side of the header plate 18. Brazing of the plates 18, 22 occurs at both the mating surfaces 26, 28 and at the points of contact between the continuous tank rib 40 and tube indentations 36 resulting in a highly rigid reinforced header structure throughout its width and length. The tube 11 is a non-clad aluminum extrusion inserted into a slightly oversized slot 20 to provide a space for the capillary action to pull braze cladding alloy into the joint to seal same.

The tank 16 is the same as the tank 14 except that a tube fitting aperture (not shown) is provided in the tank plate 22 at the opposite end or corner of the condenser 10 from the fitting aperture 31 with it being understood that either one can serve as an inlet or outlet and the other then serves the other function. The chamber forming indentations 24 in one header are staggered relative to those in the other header so that they cooperatively define a serpentine flow path through the condenser comprising several passes, as commonly known in the art.

For assembly, the tank plate 22 is clinched tightly to the header plate 18 by the tabs 34. The heat exchanger core is assembled by inserting the tubes 11 into the apertures 20 contacting the slots 42. As the assembly 10 is conveyed through a brazing furnace, the cladding melts and flows into any spaces that exist through capillary action. Fillets 50 are formed at all joints and excess cladding material flows by gravity to form puddles in the lower side of the core. The open areas around the tube 11 of approximately 0.020 collects molten cladding to form a fillet of a size that prevents cladding flow of into the tube 11 passage so as to avoid plugging of tube passages during the brazing process.

A foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and describe to revive the best illustration of the principles and is practical application to thereby enable one of ordinary skill in the art to utilize the invention in various embodiments and with various modifications as is suited to the particular use contemplated. All such modifications and variations are in the scope of the invention as determined by the appended claims when interrupted in accordance with the invention herein.

What is claimed is:

1. A heat exchanger header comprising a header plate having tube apertures for receiving heat exchanger tubes, a tank plate parallel with said header plate and having chamber indentations in one side thereof facing said header plate, said plates having mating surfaces surrounding said chamber indentations so as to define tank chambers open to selected ones of said tube apertures, said header plate having a plurality of tube indentations extending centrally therein at selected adjacent ones of said tube apertures, said tank plate having a tank rib extending within said chamber indentations forming a substantially continuous projection on said one side facing said header plate for contacting said tube indentations, and bonding material for effecting the bonding of said plates at said mating surfaces and between said tank rib and said tube indentations.

2. A heat exchanger header comprising a header plate of uniform thickness having a row of tube apertures for receiving heat exchanger tubes, a tank plate of uniform thickness parallel with said header plate and having a row of chamber indentations in one side thereof facing said header plate, said plates having mating surfaces surrounding said chamber indentations so as to define a row of tank chambers open to selected ones of said tube apertures, said header plate having a row of tube indentations extending centrally therein at selected adjacent ones of said tube apertures, said tank plate having a tank rib extending within said chamber indentations forming a projection on one side facing said header plate for contacting said tube indentations at adjacent apertures, and bonding material for effecting bonding of the plates at said bonding surfaces and said points of contact between said ribs.

3. A heat exchanger header comprising a header plate having tube apertures for receiving heat exchanger tubes, a tank plate parallel with said header plate and having chamber indentations in one side thereof facing said header plate, said plates having mating surfaces surrounding said chamber indentations so as to define tank chambers open to selected ones of said tube apertures, said header plate having a plurality of tube indentations extending centrally therein at selected adjacent ones of said tube apertures, said tank plate having a tank rib extending within said chamber indentations forming a substantially continuous projection on said one side facing said header plate for contacting said tube indentations, said tank rib includes a plurality of slots opposing said apertures for providing a tube stop therein and bonding material for effecting the bonding of said plates at said mating surfaces and between said tank rib and said tube indentations.

4. A heat exchanger header comprising a header plate of uniform thickness having a row of tube apertures for receiving heat exchanger tubes, a tank plate of uniform thickness parallel with said header plate and having a row of chamber indentations in one side thereof facing said header plate, said plates having mating surfaces surrounding said chamber indentations so as to define a row of tank chambers open to selected ones of said tube apertures, said header plate having a row of tube indentations extending centrally therein at selected adjacent ones of said tube apertures, said tank plate having a tank rib extending within said chamber indentations forming a projection on one side facing said header plate for contacting said tube indentations at adjacent apertures, said tank rib includes a plurality of slots opposing said apertures for providing a tube stop therein and bonding material for effecting bonding of the plates at said bonding surfaces and said points of contact between said ribs.

* * * * *